United States Patent [19]

Collier

[11] Patent Number: 4,916,355

[45] Date of Patent: Apr. 10, 1990

[54] GENERATOR FOR GENERATING HIGH ENERGY ELECTRONS IN A GAS

[75] Inventor: Franck Collier, Boudoufle, France

[73] Assignee: Societe Anonyme dite: Compagnie General d'Electricite, Paris, France

[21] Appl. No.: 269,333

[22] Filed: Nov. 10, 1988

[30] Foreign Application Priority Data

Nov. 17, 1987 [FR] France ..... 87 15849

[51] Int. Cl.[4] ..... H01J 1/14; H01J 1/16; H01J 17/06; H01J 35/06

[52] U.S. Cl. ..... 313/233; 313/632; 313/633; 313/354; 313/575; 313/336; 313/351; 378/136

[58] Field of Search ..... 313/231.41, 233, 352, 313/354, 363.1, 632, 633, 574, 575, 576, 309, 336, 351; 378/136; 328/233

[56] References Cited

U.S. PATENT DOCUMENTS 3,883,760 5/1975 Cunningham, Jr. ..... 378/136 X

FOREIGN PATENT DOCUMENTS 2132696 11/1972 France .
2420203 10/1979 France .

OTHER PUBLICATIONS

Review of Scientific Instruments, vol. 53, No. 7, Jul. 1982, pp. 1092–1093, American Institute of Physics, NY, USA: R. Prohaska et al., "Field emission cathodes using commercial carbon fibers".

Review of Scientific Instruments, vol. 54, No. 5, May 1983, pp. 586–590, American Institute of Physics, NY, USA, G. F. Erickson et al., "Use of carbon felt as a cold cathode for a pulsed line x-ray source operated at high repetition rates".

Soviet Technical Physics Letters, vol. 11, No. 9, Sep. 1985, pp. 458–560, American Institute of Physics, NY, USA, G. V. Kolbychev et al., "Discharge regimes in an intermediate-pressure gas with runaway electrons".

*Primary Examiner*—Kenneth Wieder
*Attorney, Agent, or Firm*—Sughrue, Mion, Zinn, Macpeak & Seas

[57] ABSTRACT

An X-ray generator comprises an anode (4) and a cathode (10) disposed in an enclosure (2) under low helium pressure and powered by an electric pulse generator (20) providing sufficient voltage in order to generate runaway electrons. The emission face of the cathode is a section of an emission plate (10) constituted by a carbon felt whose fibers have a privileged orientation perpendicular to said face in order to encourage the emission of electrons from said face. The invention is particularly applicable to pre-ionizing the discharge chamber of a gas laser.

9 Claims, 2 Drawing Sheets

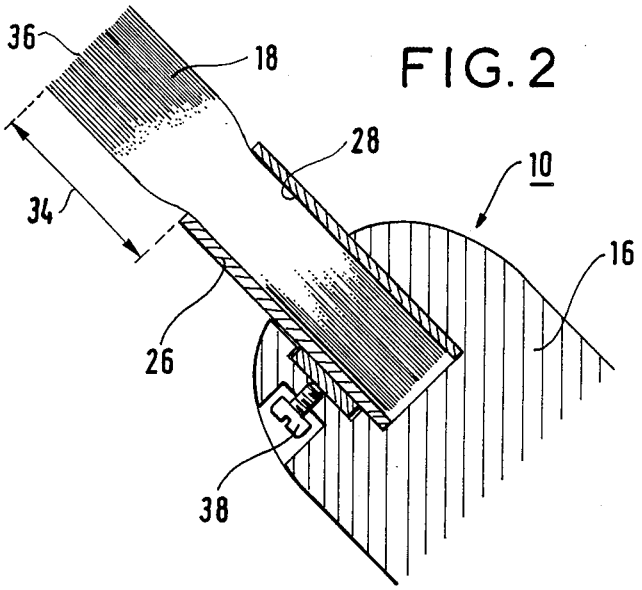
FIG. 2
FIG. 3
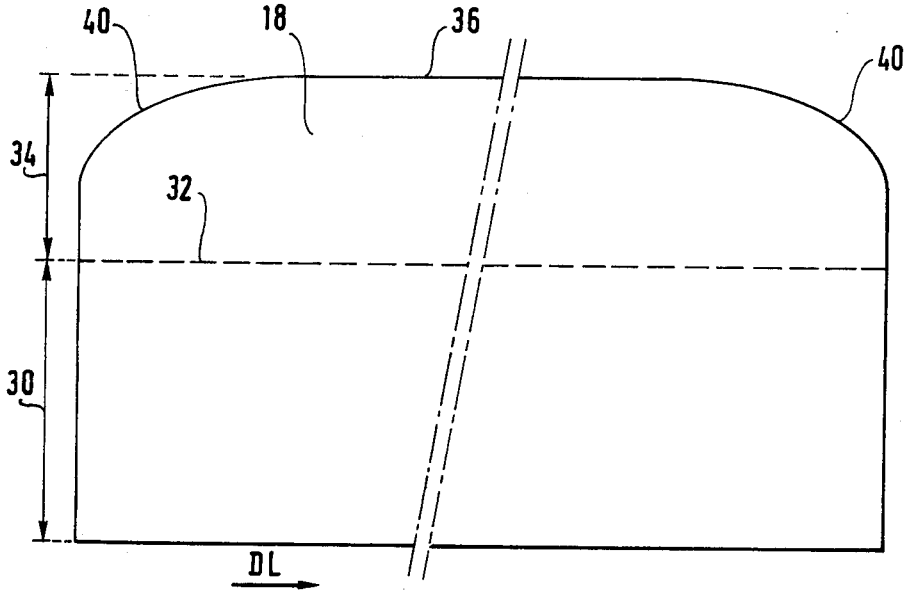

GENERATOR FOR GENERATING HIGH ENERGY ELECTRONS IN A GAS

The present invention relates to producing a beam of high energy electrons. That is to say electrons having energies lying in the range about 1 kilo electron-volt (keV) to about 100 keV.

BACKGROUND OF THE INVENTION

The users of such beams generally desire said production to be cheap, and the current density and the total intensity of the beams produced to be large.

This is particularly true when the electron beam produced is a pulsed beam for striking a target, e.g. of tantalum, in order to generate a beam of X-rays with the X-ray beam being intended to pre-ionize a discharge chamber in a pulse gas laser. In such a laser, the gaseous optical amplifying medium is pumped by an electrical discharge and the discharge is often made uniform by pre-ionizing said medium with a pulsed beam of X-rays. The X-rays must be of sufficiently high energy to be able to penetrate without substantial attenuation into the discharge chamber through a strong sealed window. They must be sufficiently intense to ensure effective pre-ionization, and to ensure it in a short period of time, e.g. 20 nanoseconds (ns). To do this, the electron beam must have high current density, e.g. 400 amps per square centimeter ($A/cm^2$).

The most widely used generators of high energy electrons in such an application are cold cathode pulse guns. They generally operate in a so-called "secondary" high vacuum of $10^{-3}$ or $10^{-4}$ Pascals (Pa) for example, so as to ensure that the electrons emitted by the cathode and accelerated by an electric field towards the anode are not slowed down too much by collisions with the residual gas.

The need to maintain such a vacuum increases the manufacturing and maintenance cost of such a generator and also makes it more bulky.

That is why electron generators have been proposed that operate at an ambient pressure which is low but easy to obtain and to maintain. Work performed by the Collins team at the University of the Colorado on D.C. guns using alumina or carbon cathodes has made it possible to obtain 5 keV electrons using a current of 1 A. Their cathodes are flat or concave and the cathode-anode distance is not critical beyond the cathode black space. Yield reached 50%. The ambient gas was helium at a pressure lying in the range about 10 Pa to about 100 Pa.

Such a generator is described, in particular, in an article by J. J. Rocca, J. D. Meyer, M. R. Farrel, and G. J. Collins, in the Journal of Applied Physics, 56, 790 (1984).

This generator is referred to below as a Collins generator.

Other electron guns operating in low pressure helium have been described in various articles, and in particular in the following:

C. H. H. Carmichael, R. K. Garnsworthy, L. E. S. Mathias, Re. Sci. Instrum. 44, 701 (1973).

P. A . Boklan and G. V. Kolbychev, Sov. Phys. Tech. Phys. 26, 1057 (1981).

G. V. Kolbychev and I. V. Plashnik, Sov. Tech. Phys. Lett. 11, 458 (1985).

These generators appear to be less advantageous than the Collins generator.

In the Collins generator, the slowing down of electrons due to collisions with the ambient gas is made unimportant by using an acceleration voltage which is sufficiently high (e.g. 8 kilovolts (kV) or more) in association with a pressure which is low enough for a considerable fraction of the electrons emitted by the cathode to reach sufficient energy prior to encountering a molecule of the ambient gas to ensure that its collision cross-section is greatly reduced. The term "collision cross-section" represents the probability of collision with such molecules.

Such electrons are known as "runaway electrons". Because of their low probability of being slowed down by collisions, they acquire an amount of energy as they travel from the cathode to the anode which is more than half the energy that they would have acquired in a vacuum under the same accelerating field.

Unfortunately, the high voltage and low pressure used encourage discharge between the cathode supports and the anode, thereby making it impossible to obtain a stable diffuse discharge having high current density in the cathode-anode gas. It is therefore necessary to provide electrically insulating coatings on the anode and cathode supports, thereby complicating generator construction.

The object of the present invention is to produce high energy electrons in a manner which is simpler and cheaper, while using very high current densities, at least instantaneously, together with production efficiency close to that obtained in a secondary vacuum.

SUMMARY OF THE INVENTION

A generator in accordance with the present invention has some features in common with a Collins generator. These features are as follows:

an enclosure;

an ambient gas present in said enclosure at an ambient pressure of more than about 5 Pa in order to facilitate the construction of said generator, and less than about 100 Pa in order to enable said high energy electrons to be produced;

an anode in said enclosure;

a cathode situated in said enclosure facing said anode and including emission means for emitting electrons;

dielectric support means for holding the said anode and said cathode and forming a flashover distance which is long enough to avoid any surface arcing; and a source of electric current for applying an accelerating field suitable for emitting electrons from said cathode and accelerating them towards said anode through said ambient gas, the ratio of said accelerating field to said ambient pressure being selected to be high enough to create a diffuse discharge in which the majority of the electrons emitted by said cathode initially acquire sufficient energy to substantially reduce their collision cross-section with the molecules of said ambient gas such that they subsequently acquire more energy between two collisions, on average, than they lose during each collision, with the electrons thus becoming runaway electrons having sufficient energy to constitute said high energy electrons.

Compared with a Collins generator, a generator in accordance with the present invention includes the improvement whereby said emission means are in the form of an emission plate constituted by interlaced carbon fibers having a privileged orientation along an emission direction directed towards said anode.

More precisely, said emission plate has two opposite main faces, a length along a longitudinal direction and a width along an emission direction, with both said length and said width being parallel to said main faces, said plate further having a thickness along a transverse direction perpendicular to said main faces, said emission plate further presenting an emission face facing said anode and intersecting said emission direction, said emission face having a length constituted by said plate length and a width constituted by said plate thickness, said carbon fibers being disposed, at least locally, with an orientation that privileges said emission direction at least in comparison with said transverse direction in such a manner that the area density of the free ends of said fibers is greater on said emission face than on said main faces;

said cathode further including an emission plate support which is setback from said emission face, said support being in contact with a holding strip which is constituted by a portion of the width of said emission plate at a distance from said emission face in order to hold said emission plate by means of said holding strip, with the remaining portion of the width of said emission plate up to said emission face constituting an exposed strip, said support being electrically conductive and being connected to said source of electric current in order to feed said carbon fibers with electricity from said holding strip.

These dispositions of the present invention give rise to a large area density of said carbon fiber ends in said emission face which encourages the emission of electrons from said face while a small density of said ends in said main faces of said emission plate contributes to avoiding such emission from said faces in said exposed strip, and simultaneously the setback position of said emission plate support relative to said emission surface avoids electrons being emitted from the surface of said support, and finally the electrical resistance of said carbon fibers causes the emission of electrons from the surface of said emission face to be rendered uniform.

According to the present invention, the following, sometimes preferred dispositions may also be adopted:

if an orientation ratio of said emission plate is defined as being the ratio of surface densities of the free ends of said carbon fibers in said emission face and in said main faces, said ratio is greater than two, and preferably greater than ten;

said emission plate is constituted by a carbon felt carded along said emission direction and moderately needled in order to impart cohesion thereto while causing only a moderate number of free fiber ends to appear in said main faces, said number being preferably very small; and the fibers of this felt have a diameter lying in the range 1 micrometer ($\mu$m) to 100 $\mu$m, and preferably in the range 4 $\mu$m to 20 $\mu$m, and resistivity lying in the range $3.10^3$ ohm centimeters ($\Omega$.cm) and $4.10^{-3}$ $\Omega$.cm.

It should be observed that carbon felt emission plates have already been used for making the emission face of the cathode in an electron gun. One such utilization is described, in particular, in an article by G. F. Erickson and P. N. Mace in Rev. Sci. Instrum. 54, 585/1883. However, this gun operates in a vacuum and not with runaway electrons in a gas. As a general rule, substances which are suitable for operating under a low pressure (enabling runaway electrons to be produced) are not the same as substances which are suitable for operating under a secondary vacuum. More precisely, tests under moderate pressure using commonly used materials such as steel, stainless steel, aluminum, and tantalum, have not made it possible to obtain discharge and high energy electrons whereas these materials give good results under a secondary vacuum.

It may also be observed that low pressure discharge conditions (at less than 100 bar) are not favorable a priori for making an electron gun since when a conventional cathode is used (e.g. a steel rasor blade) there is no field effect emission between the blade and the anode (as in a secondary vacuum) but instead there are long arcs (1) (compared with the anode-cathode distance, e.g. 5 mm) between the cathode support and the anode, as can be seen, in particular, from an article by James Dillon Cobine entitled Gaseous Conductors (Dovers Publ. Inc. New York), p. 164. Under such circumstances, the gun cannot operate.

Further sometimes-preferred dispositions in accordance with the present invention include:

said exposed strip has a width lying in the range 1 mm to 10 mm, with said ambient pressure lying in the range 10 Pa to 50 Pa, said accelerator field lying in the range $5.10^5$ and $20.10^5$ volts per centimeter (V/cm), and with the distance between said emission face and said anode being greater than about 2 mm;

said ambient gas is helium; and said anode is a block of heavy metal and said source of electric current is an electric pulse source in order to constitute an X-ray pulse gun.

BRIEF DESCRIPTION OF THE DRAWINGS

An implementation of the present invention within the scope of the above description is provided below in greater detail by way of non-limiting example with reference to the accompanying diagrammatic figures. When the same item occurs in several figures it is designated in each of them by the same reference symbol. The implementation given by way of example includes the dispositions mentioned above as being sometimes preferred. It should also be understood that the items mentioned may be replaced by others which provide the same technical functions.

FIG. 2 is a view on a larger scale of a detail II of FIG. 1.

FIG. 3 is a front view on a larger scale of the emission plate of the FIG. 1 generator.

MORE DETAILED DESCRIPTION

Figure 1:
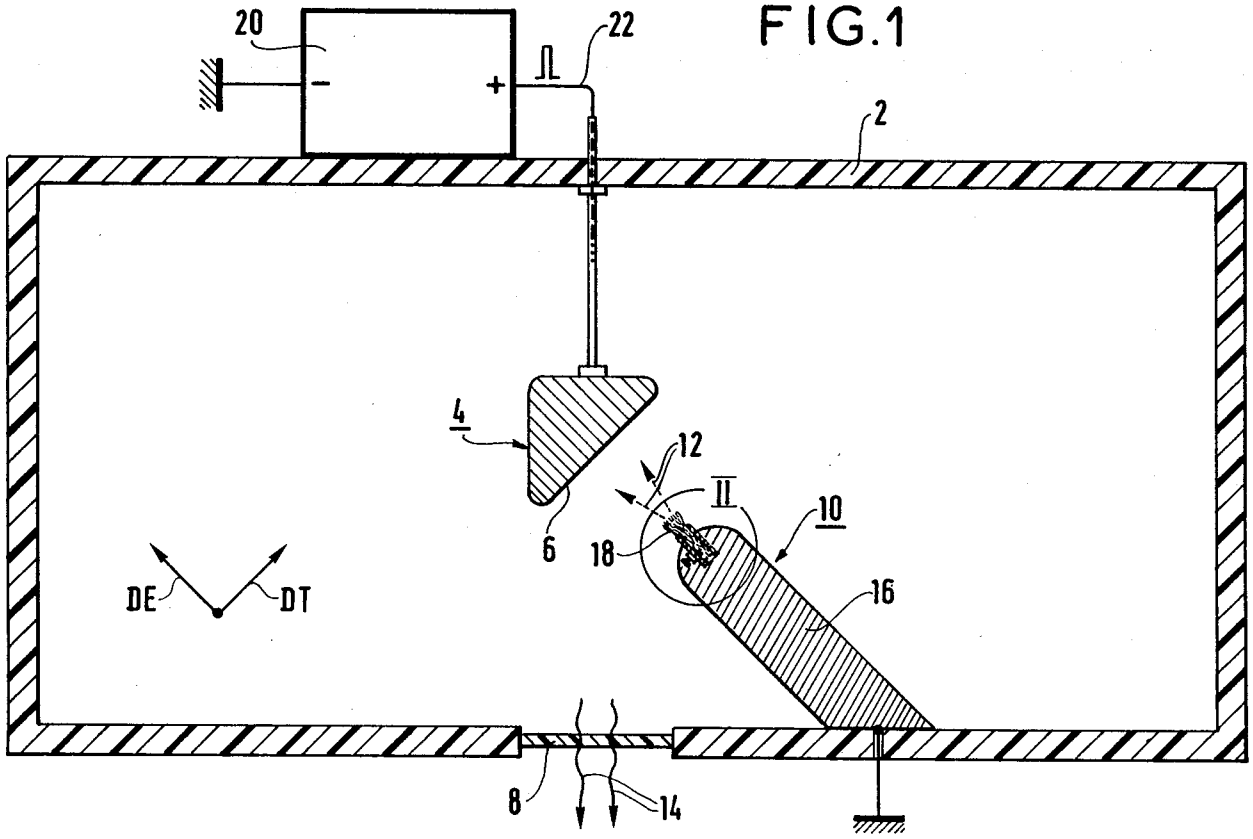
FIG. 1 is a section view through a generator in accordance with the invention.

In FIG. 1, said enclosure is referenced 2. It is made of polymethyl methacrylate. Said ambient gas in said enclosure is helium and said ambient pressure is 20 Pa.

Said longitudinal direction is perpendicular to the plane of FIG. 1. It is referenced DL in FIG. 3.

Said anode is referenced 4. It is constituted by a block of tantalum and it has a working face 6. This face is inclined at 45° in order to receive electrons 12 and respond by emitting X-rays 14 through a window 8 formed by a thinner portion of the wall of the enclosure 2. This window is about 2 millimeters (mm) thick.

Said emission direction DE is perpendicular to said working face and said transverse direction DT is parallel thereto.

Said cathode is referenced 10. It comprises said metal support 16 and said emission plate 18 which are shown in greater detail in FIGS. 2 and 3.

The anode 4, the window 8, and the cathode 6 extend along said longitudinal direction over a length of 150 mm.

The width of the anode 4 in said transverse direction is 10 mm. The gap between the anode and the cathode 10 is 4 mm to 6 mm.

Said source of electrical current is a Marx generator 20 which applies a 60 kV pulse to the anode 4 for a period of 20 ns with a peak current of 1.2 kA, via a conductor 22, with the cathode 10 being grounded.

As shown in FIGS. 2 and 3, the emission plate 18 is held in the support 16 between two thin stainless steel blades such as 26 which are disposed on said two main faces such as 28 of the emission plate 18.

These blades cover a portion only of the with of said faces, with said width being measured along the emission direction DE. This portion constitutes said holding strip 30 beneath a dashed line 32 in FIG. 3, with the portion 34 situated thereabove constituting said exposed strip. The free edge thereof constitutes said emission face 36 facing the anode 4. This face is referred to below as being the top face of the emission plate 18. A bottom portion of the width of the two blades such as 26 having the emission plate 18 interposed therebetween is disposed in a longitudinal groove formed in the top of the support 16 in order to hold the assembly constituted by the emission plate 18 and said two blades.

A screw 38 presses against one of the two blades along said transverse direction in order to clamp the emission plate 18 between said two blades within said holding strip. Since the plate 18 is deformable, its thickness is reduced in said strip. In the exposed strip 34, the thickness of the plate, i.e. the width of the emission face 36, is 2 mm, with the width of said strip being 4 mm.

The emission plate 18 is rounded at 40 along both of its longitudinal edges, as can be seen in FIG. 3, in order to avoid locally reinforcing the electric field and thus in order to avoid emitting electrons.

The emission 18 is made of a carbon felt of the type sold, for example, by the French company Le Carbone Lorraine under its reference RVG 1000, e.g. for the purpose of constituting heat insulating layers in vacuum ovens. This felt is obtained by carding rayon fibers followed by moderate needling, and then carbonization at a temperature which is high enough to ensure that a substantial portion of the carbon is transformed into graphite.

The fibers in said felt have diameters lying in the range 5 μm to 12 μm with the majority of fibers having a diameter of about 7 μm to 8 μm. Their resistivity is $3\frac{1}{2}.10^{-3}$ Ω.cm. Said orientation ratio is 20 or greater.

Naturally, said carbon fibers may also be used in the form of a woven cloth.

A generator in accordance with the invention has provided an electron current of 300 A/cm$^2$ with production efficiency of as high as 80% of that obtained in a secondary vacuum.

What is claimed:

1. A generator for generating high energy electrons in a gas, said generator comprising:

an enclosure;

an ambient gas present in said enclosure at an ambient pressure of more than about 5 Pa in order to facilitate the construction of said generator, and less than about 100 Pa in order to enable said high energy electrons to be produced;

an anode in said enclosure;

a cathode situated in said enclosure facing said anode and including emission means for emitting electrons;

dielectric support means for holding the said anode and said cathode and forming a flashover distance which is long enough to avoid any surface arcing; and a source of electric current for applying an accelerating field suitable for emitting electrons from said cathode and accelerating them towards said anode through said ambient gas, the ratio of said accelerating field to said ambient pressure being selected to be high enough to create a diffuse discharge in which the majority of the electrons emitted by said cathode initially acquire sufficient energy to substantially reduce their collision cross-section with the molecules of said ambient gas such that they subsequently acquire more energy between two collisions, on average, than they lose during each collision, with the electrons thus becoming runaway electrons having sufficient energy to constitute said high energy electrons;

wherein said emission means are in the form of an emission plate constituted by interlaced carbon fibers oriented along an emission direction directed towards said anode.

2. A generator according to claim 1, wherein said emission plate has two opposite main faces, a length along a longitudinal direction and a width along an emission direction, with both said length and said width being parallel to said main faces, said plate further having a thickness along a transverse direction perpendicular to said main faces, said emission plate further presenting an emission face facing said anode and intersecting said emission direction, said emission face having a length constituted by said plate length and a width constituted by said plate thickness, said carbon fibers being disposed, at least locally, with an orientation that privileges said emission direction at least in comparison with said transverse direction in such a manner that the area density of the free ends of said fibers is greater on said emission face than on said main faces;

said cathode further including an emission plate support which is setback from said emission face, said support being in contact with a holding strip which is constituted by a portion of the width of said emission plate at a distance from said emission face in order to hold said emission plate by means of said holding strip, with the remaining portion of the width of said emission plate up to said emission face constituting an exposed strip, said support being electrically conductive and being connected to said source of electric current in order to feed said carbon fibers with electricity from said holding strip, in such a manner that a large area density of said carbon fiber ends in said emission face encourages the emission of electrons from said face while a small density of said ends in said main faces of said emission plate contributes to avoiding such emission from said faces in said exposed strip and also such that the setback position of said emission plate support relative to said emission surface avoids electrons being emitted from the surface of said support, and finally such that the electrical resistance of said carbon fibers causes the emission of electrons from the surface of said emission face to be rendered uniform.

3. A generator according to claim 2, in which said emission plate has an orientation ratio which is greater than two, where said ratio is the ratio between the surface density of the free ends of said carbon fibers in said emission face divided by the density thereof in said main faces.

4. A generator according to claim 3, wherein said emission plate is constituted by a carbon felt carded along said emission direction and moderately needled in order to impart cohesion thereto while causing only a moderate number of free ends of said carbon fibers to appear in said main faces.

5. A generator according to claim 1, wherein said carbon fibers have a diameter lying in the range 1 $\mu$m to 100 $\mu$m.

6. A generator according to claim 5, wherein said exposed strip has a width lying in the range 1 mm to 10 mm, with said ambient pressure lying in the range 10 Pa to 50 Pa, said accelerator field lying in the range $5.10^5$ and $20.10^5$ volts per centimeter, and with the distance between said emission face and said anode being greater than about 2 mm.

7. A generator according to claim 6, wherein the resistivity of said carbon fibers lies in the range $3.10^{-3}$ and $4.10^{-3}$ $\Omega$.cm.

8. A generator according to claim 6, in which said ambient gas is helium.

9. A generator according to claim 8, in which said anode is a block of heavy metal and said source of electric current is an electric pulse source in order to constitute an X-ray pulse gun.

* * * * *